US005467896A

United States Patent [19]

Hols

[11] Patent Number: 5,467,896

[45] Date of Patent: Nov. 21, 1995

[54] NO DRIP POUR SPOUT

[76] Inventor: Lyle W. Hols, 8800 Topanga Canyon, Apartment 8, Chatsworth, Calif. 91304

[21] Appl. No.: 231,925

[22] Filed: Apr. 25, 1994

[51] Int. Cl.[6] ..... B67D 5/00

[52] U.S. Cl. ..... 222/83; 222/90; 222/91; 222/108

[58] Field of Search ..... 222/83, 90, 91, 222/108, 478, 479, 569, 571, 568, 82, 83.5, 85; 141/329, 331, 311 A, 339

[56] References Cited

U.S. PATENT DOCUMENTS

| | | | |
|---|---|---|---|
| 1,523,696 | 1/1925 | Lewis | 222/568 |
| 1,971,284 | 8/1934 | Stockman | 222/90 |
| 2,551,099 | 5/1951 | Cosdon | 222/478 |
| 2,594,161 | 4/1952 | Harrison | 222/478 |
| 2,666,553 | 1/1954 | Tammi | 222/90 |
| 3,856,188 | 12/1974 | Newby | 222/478 |

FOREIGN PATENT DOCUMENTS

| | | | |
|---|---|---|---|
| 892492 | 3/1962 | United Kingdom | 222/478 |

*Primary Examiner*—Andres Kashnikow
*Assistant Examiner*—Philippe Derakshani

[57] ABSTRACT

A no drip pour spout including a tapering tubular spout having a lid piercing member affixed to a larger end thereof using a perforated interface member wherein the interface member has a liquid collection lip arranged to gather liquid which ordinarily would drip from the container. The liquid collection lip is drained by a liquid recovery conduit which is connected to the smaller end of the tapering tubular spout. Liquid which would ordinarily drip from the container is forceably removed from the liquid collection lip by slight suction created by liquid flow through the tapering tubular spout and by gravity. An alternate embodiment includes a provision for use with threaded cover bottle type liquid containers.

4 Claims, 2 Drawing Sheets

NO DRIP POUR SPOUT

BACKGROUND OF THE INVENTION

1. Field of the Invention

The present invention relates to pour spout apparatus and more particularly pertains to a no drip pour spout which may be employed to eliminate drips when pouring liquids from an liquid container.

2. Description of the Prior Art

The use of pouring spouts is known in the prior art. More specifically, pouring spouts heretofore devised and utilized for relatively spill free transport of a liquid from a filled container are known to consist basically of familiar, expected and obvious structural configurations, notwithstanding the myriad of designs encompassed by the crowded prior art which have been developed for the fulfillment of countless objectives and requirements.

The present invention is directed to improving devices for a no drip pour spout in a manner which is safe, secure, economical and aesthetically pleasing.

For example, Taylor U.S. Pat. No. 4,832,238 discloses an oil spout comprising an elongated flexible tapering tube having a butterfly valve control disposed therein providing control of fluids flowing therethrough. An enlarged end of the Taylor invention tube threadedly fastens to an oil can from which liquid oil is to be extracted. The Taylor invention reduces the likelihood of spills by having a great degree of flexibility and having a flow control valve. The Taylor invention does not penetrably interface with containers such as oil cans and is threadedly attachable to a particular oil container type. The present invention comprises an oil spout releasably affixable to can type fluid containers as well as versions threadedly engaging bottle type containers and furthermore provides an oil recovery conduit which conveys fluid captured by a sealing lip disposed upon the upper edge of the can to the region within which fluid is being collected.

In Fessel U.S. Pat. No. 5,042,698 an easy pour spout is disclosed wherein a threadedly attaching spout having a manually activated valve assembly and a pressure equalization tube engages a liquid filled container thereby permitting substantially spill free transfer of fluids contained therein. The Fessel invention has no provision for penetratably attaching to a can type fluid container and there is no provision to prevent some dripping when fluid flow is terminated. The present invention penetrably affixes to a can type liquid container and may be provided in a threadedly engaging version for use with bottle type containers. The present invention employs a bypass conduit which prevents drips by removing surplus fluid to the region being filled and by providing a pressure gradient to replace a portion of drip forming fluid within the liquid source container.

In James U.S. Pat. No. 5,020,702 a liquid pouring spout is described. The James invention comprises an elongated flexible tapering tube having a butterfly valve control disposed therein providing control of fluids flowing therethrough. An enlarged end of the James invention threadedly affixes to a series of liquid filled bottle types from which liquid may be extracted. The James invention reduces the likelihood of spills by having a great degree of flexibility and having a flow control valve. The James invention does not penetrably interface with containers such as oil cans but is threadedly attachable to a funnel. The present invention comprises an oil spout releasably affixable to can type fluid containers as well as versions threadedly engaging bottle type containers and furthermore provides an oil recovery conduit which conveys fluid captured by a sealing lip disposed upon the upper edge of the can to the region within which fluid is being collected.

In Penn U.S. Pat. 5,005,732 an oil can spout with flow control is disclosed for providing controlled flow of oil from an existing bottle type oil container using a slidably engaging valve and a substantially shortened tubular conduit. A disadvantage in this prior art lies in a lack of provision for penetratably attaching to a can style container, and there is no provision for preventing oil drips occurring after the valve is closed. The present invention penetrably engages a can type liquid filled container and furthermore has a liquid recovery conduit which prevents liquid dripping.

Osowiecki U.S. Pat. No. Des. 323,295 discloses the ornamental design for a combined cap and pour spout for oil containers. The disclosure teaches a jogged tapering tube having a minimum diameter portion engaging an oil container and a maximum diameter portion fitted with a cap and providing a wide aperture pour spout. The disclosure makes no provision for penetrably engaging an oil can and has no provision for recovering or otherwise using oil forming drips.

In this respect, the no drip pour spout according to the present invention substantially departs from the conventional concepts and designs of the prior art, and in so doing provides an apparatus primarily developed for the purpose of pouring liquids from containers with minimal spilling and dripping.

Therefore, it can be appreciated that there exists a continuing need for new and improved no drip pour spout which can be employed by humans to pour liquids from containers without spilling or dripping. In this regard, the present invention substantially fulfills this need.

As illustrated by the background art, efforts are continuously being made in an attempt to improve liquid pouring apparatus. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of pour spouts now present in the prior art, the present invention provides an improved no drip pour spout construction wherein the same can be utilized for pouring liquids with minimal dripping or spilling. As such, the general purpose of the present invention, which will be described subsequently in greater detail, is to provide a new and improved no drip pour spout apparatus and method which has all the advantages of the prior art pour spouts and none of the disadvantages.

The invention is defined by the appended claims with the specific embodiment shown in the attached drawings. For the purpose of summarizing the invention, the invention may be incorporated into a curving tapered spout penetratably engaging a can such as commonly employed to hold automotive engine oil. A small diameter tubular conduit is installed substantially as a chord of the smaller radius of curvature portion of the curving tapered spout and connecting a site near a spout free end to a site adjacent the spout at a can engagement end. A small standoff rim sealably engages the lid of the can and at least partially surrounds a hollow lid penetrator forming a can engagement member. During operation oil generally leaks around the lid penetrator and is temporarily collected in the interspace formed between the standoff rim and the can lid. As liquid flow through the spout increases and the angle of the tubular conduit moves past a true horizontal the liquid collected in the interspace forcibly joins the main stream fluid flow through the spout free end by a pressure differential experienced between two ends of the conduit. Throughout operation there can be no buildup of oil at the can lid and therefore drips and spills are avoided.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved no drip pour spout having an oil recovery conduit which precludes loss of oil or other liquids through spills and dripping during a liquid transfer procedure.

It is therefore an additional object of the present invention to provide a new and improved no drip pour spout which has all the advantages of the prior art pour spouts and none of the disadvantages.

It is another object of the present invention to provide a new and improved no drip pour spout which may be easily and efficiently manufactured and marketed.

It is a further object of the present invention to provide a new and improved no drip pour spout which is of a durable and reliable construction.

An even further object of the present invention is to provide a new and improved no drip pour spout which is susceptible of a low cost of manufacture with regard to both materials and labor, and which accordingly is then susceptible of low prices of sale to the consuming public, thereby making such no drip pour spouts economically available to the buying public.

Still yet another object of the present invention is to provide a new and improved no drip pour spout which provides in the apparatuses and methods of the prior art some of the advantages thereof, while simultaneously overcoming some of the disadvantages normally associated therewith.

Still another object of the present invention is to provide a new and improved no drip pour spout usable with existing can type containers for pourably extracting contents therefrom without spilling or dripping.

Yet another object of the present invention is to provide a new and improved no drip pour spout which may be employed to eliminate dripping in bottle type liquid containers.

Even still another object of the present invention is to provide a new and improved no drip pour spout susceptible of manufacture using casting or injection molding techniques.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
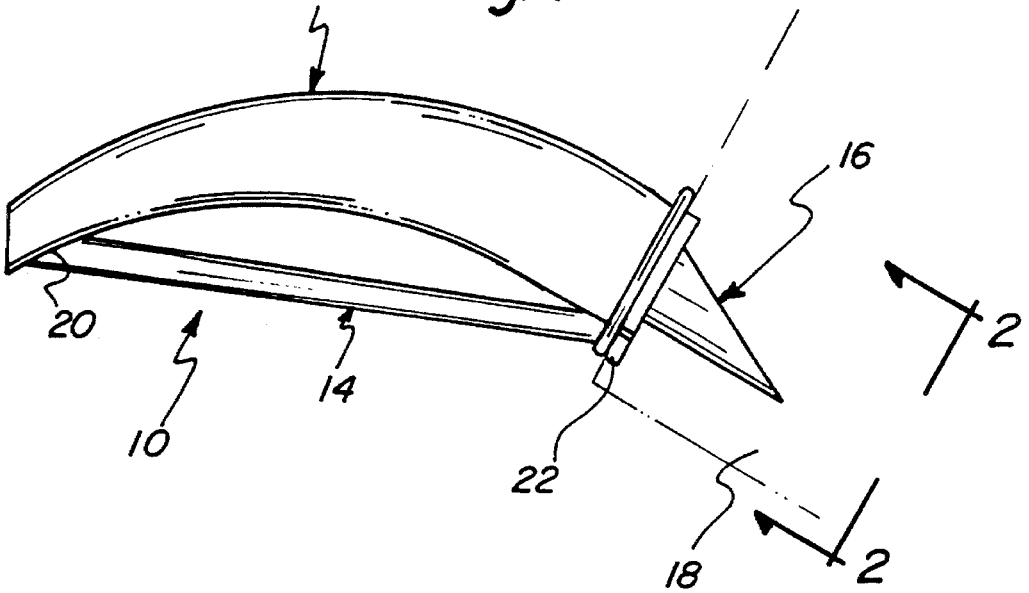
FIG. 1 is a side elevational view of the no drip pour spout showing the liquid recovery conduit.

With reference now to the drawings, and in particular to FIG. 1 thereof, a new and improved no drip pour spout embodying the principles and concepts of the present invention and generally designated by the reference numeral 10 will be described.

From an overview standpoint, the no drip pour spout is adapted for use with liquid filled containers for the purpose of achieving drip free pouring comprising a tapering curved tubular spout member 12 a liquid recovery conduit 14, and a lid piercing member 16. See FIG. 1. Container 18 is piercedly penetrated by lid piercing member 16 and by frictional engagement holds the no drip pour spout 10 in position on container 18. In a pouring process involving translation and rotation of the container 18 the spout member 12 is positioned so that gravitational force stimulates liquid flow therethrough. Passage of liquid past an end 20 of conduit 14 produces a low pressure region by the well established Bernoulli principle. The low pressure region at end 20 removes any liquid gathered at lip 22 which ordinarily would produce a drip. Additionally, when container 18 is rotated such that conduit 14 achieves an angular disposition wherein end 20 is below a true horizontal plane passing through an opposite end of conduit 14 the force of gravity further stimulates removal of liquid at lip 22.

Figure 2:
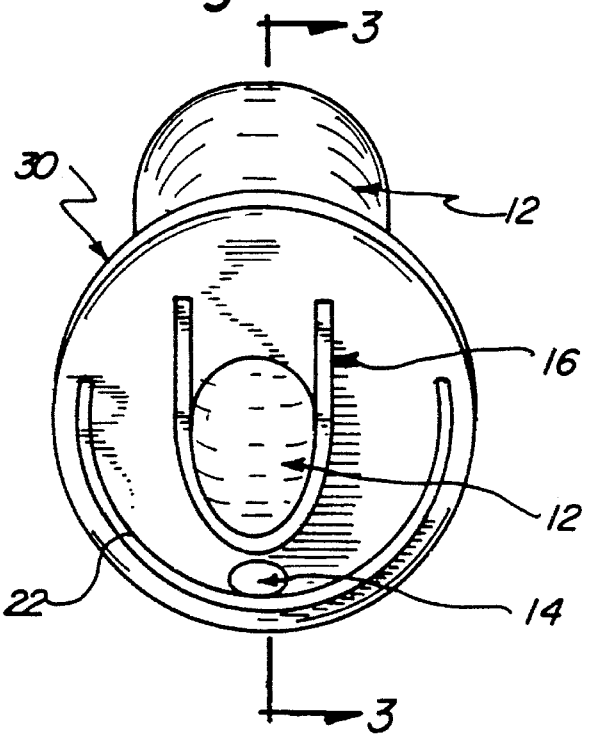
FIG. 2 is a side elevational view of the no drip pour spout taken substantially upon the plane indicated by the section line 2—2 of FIG. 1 and furthermore showing a can type container penetration end.
Figure 3:
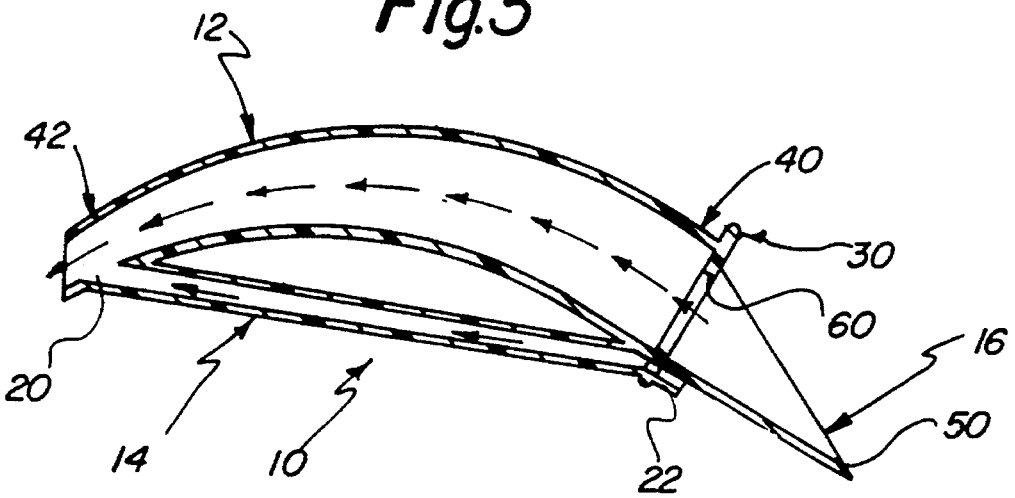
FIG. 3 is side sectional view of the no drip pour spout taken substantially upon the plane indicated by the section line 3—3 of FIG. 2.
Figure 4:
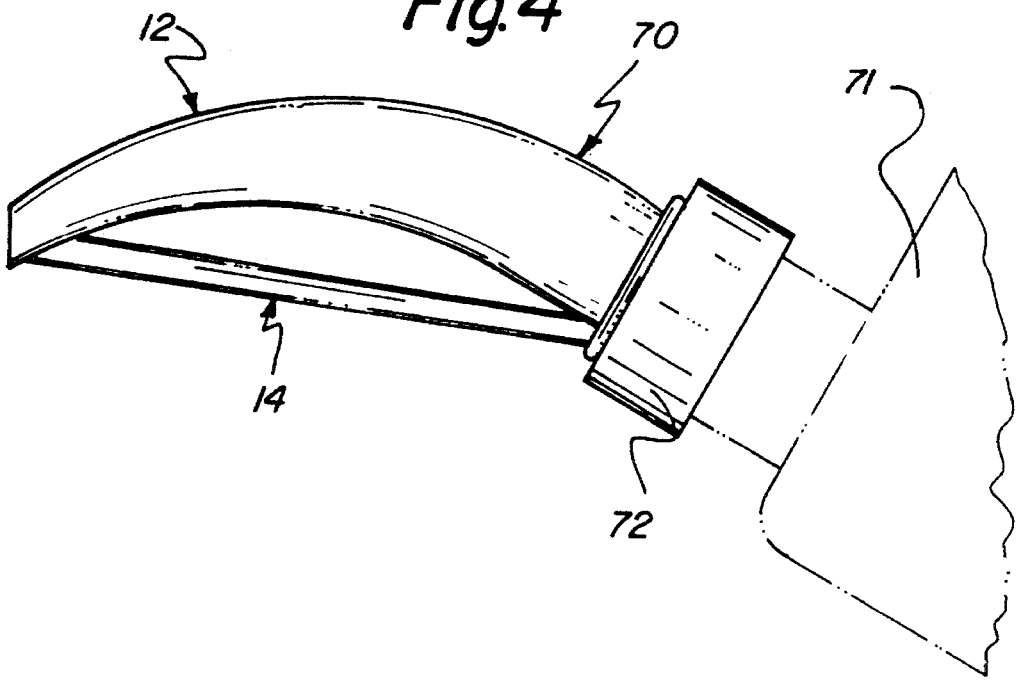
FIG. 4 is a side elevational view of the no drip pour spout showing a threaded engagement means.

More specifically, it will be noted that the no drip pour spout 10 comprises a tapering tubular spout member 12 interconnecting a lid piercing member 16 by interconnection means 30, liquid recovery conduit 14, and lip 22. See FIG. 2. Tubular spout member 12 comprises a thin wall tubular structure tapering from a large end 40 to a small end 42 and having a smooth curvature resulting in a small to moderate angular difference between an axis of large end 40 and an axis of small end 42. See FIG. 3. Tubular spout member 12 is generally of plastic or metallic composition and may be molded, cast, or otherwise formed using conventional techniques.

Lid piercing member 16 comprises a smoothly curving thin wall member 50 having a substantially right triangular projected area in a plane containing the tapering curved spout 12 and the centers of curvature of the tapering curved spout 12. And wall member 50 has a smoothly curving projected outline in any of two remaining orthogonally disposed projection planes. Edge may be flattened having sharp edges or may be taperingly sharpened to facilitate penetration of metal or plastic can lids.

Interconnection means 30 comprises a substantially planar platelike member of generally circular shape perforated by a first aperture 60 and a second aperture wherein said first aperture permits free passage of liquids therethrough to the large end 40 of spout 12 and said second aperture permits free passage of liquids therethrough to an end of liquid recovery conduit 14. Interconnection means 30 has affixed thereon upon a first planar side the large end 40 of spout 12, an end of liquid recovery conduit 14, and upon a second planar side the lid piercing member 16 and lip 22. Attachment of one or more of the aforementioned to the interconnection means 30 may be by gluing, welding, molding or casting as a continuous part, or other joining means generally producing a leak free continuous joint.

Lip 22 comprises a substantially semicircular ridge affixed to interconnection means 30 on one major edge and engaging lid 18 along a second major edge. Engagement of the second major edge of lip 22 with lid 18 substantially provides a liquid transport barrier and a conforming sealing member may additionally applied thereon. The method of affixing lip 22 to interconnection means 30 may be a glue, or a continuity of molded or cast parts, or a weld. In use, lip 22 produces a small interspace which collects liquids ordinarily lost by spilling or dripping and permits the passage of said collected liquids through recovery conduit 14.

In an alternate embodiment, the no drip pour spout 70 is adapted to fit bottle style containers 71 having a threaded port thereon. The no drip pour spout 70 comprises a tapering curved spout 12, a liquid recovery conduit 14, and a threadedly engaging connector 72. Fluid recovery conduit 14 removes fluid from a region at an imperfect seal generally experienced in threadedly affixing apparatus to mating polymeric bottle style containers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved no drip pour spout for preventing loss of liquids during pouring from a container wherein said container is a can having a substantially planar lid comprising:

a tapering curved tubular spout member having a larger end thereof affixed to a first major side of a multiply perforated platelike interface member wherein a large perforation is disposed in substantial alignment with a bore of said larger end of the spout member and a smaller end thereof opens freely and having a small aperture disposed a short distance from a free end, a curved lip member affixed to a second major side of the multiply perforated platelike interface member wherein said second major side is an outer surface opposing said first major side and a small perforation is disposed between the lip member and the bore of said larger end of the spout member, a lid penetration means which penetrably engaged the lid and directs fluid within the container to the large perforation of the multiply perforated interface member, and a liquid recovery conduit interconnecting said small perforation in said multiply perforated interface member and said small aperture in said spout member.

2. The new and improved no drip pour spout of claim 1 wherein the materials of construction are plastic or metal.

3. A new and improved no drip pour spout for preventing loss of liquids during pouring from a container wherein said container is a bottle having a threadedly engaging closure comprising:

a tapered curved tubular spout member having a larger end thereof affixed to a first major side of a multiply perforated platelike interface member wherein a large perforation is disposed in substantial alignment with a bore of said larger end of the spout member and a smaller end thereof opens freely and has a small aperture disposed a short distance from a free end, a threaded attachment means engaging the threaded closure portion of the container and detachably affixing the no drip pour spout thereon, and a liquid recovery conduit formed in a hollow elongated configuration and interconnecting a small perforation in said multiply perforated interface member and said small aperture in said spout member.

4. The new and improved no drip pour spout of claim 3 wherein the materials of construction are plastic or metal.

* * * * *